US005100414A

United States Patent [19]

Dolev

[11] Patent Number: 5,100,414

[45] Date of Patent: Mar. 31, 1992

[54] ROTARY HEAD MULTI-SPRING HAIR REMOVAL DEVICE

[76] Inventor: Moshe Dolev, 22 Yehiam St., Ramat Hasharon, Israel

[21] Appl. No.: 664,757

[22] Filed: Mar. 5, 1991

[51] Int. Cl.[5] ..... A61B 19/00

[52] U.S. Cl. ..... 606/133; 606/131

[58] Field of Search ..... 606/36, 43, 131, 133

[56] References Cited

U.S. PATENT DOCUMENTS

| | | | |
|---|---|---|---|
| 1,923,415 | 8/1933 | Bingham . | |
| 2,496,223 | 1/1950 | Lanzisera | 606/133 |
| 2,900,661 | 8/1959 | Schnell | 606/133 |
| 4,079,741 | 3/1978 | Daar et al. | 606/133 |
| 4,524,772 | 6/1985 | Daar et al. | 606/133 |
| 4,575,902 | 3/1986 | Alazet | 606/133 |
| 4,726,375 | 2/1988 | Gross et al. | 606/133 |
| 4,807,624 | 2/1989 | Gross et al. | 606/133 |
| 4,923,460 | 5/1990 | Amit | 606/133 |
| 4,935,024 | 6/1990 | Dolev | 606/133 |
| 5,032,126 | 7/1991 | Cleyet et al. | 606/133 |

FOREIGN PATENT DOCUMENTS

| | | | |
|---|---|---|---|
| 0147285 | 7/1985 | European Pat. Off. | 606/133 |

*Primary Examiner*—Stephen C. Pellegrino

*Assistant Examiner*—Glenn K. Dawson

*Attorney, Agent, or Firm*—Edward Langer

[57] ABSTRACT

A hair removal device having a plurality of springs mounted on a rotary head and arranged to open and close during rotation, to trap and pluck skin hair over a relatively wide area. In a preferred embodiment, the rotary head multi-spring design is provided as a hand-held, motor-powered depilatory device having a cup-like rotor formed with two concentric supports. A plurality of compression coil springs are mounted in in freely rotatable fashion on pins extending radially between the supports. The springs have normally open loops with spaces between them along the pin length. A cam is arranged proximate the pins such that when the rotary head rotates about a shaft, the pins slide radially between the supports in accordance with the cam shape. Radial movement of the pin forces a shoulder formed at one end against the end of the spring, compressing and closing its loops. When passed over the skin, the loops of each spring mounted on the rotary head rotate freely on the skin, reducing friction, while the loops open and close over a wide area, and skin hair in this area is grasped and plucked as the loops close, performing the hair removal function.

16 Claims, 2 Drawing Sheets

ROTARY HEAD MULTI-SPRING HAIR REMOVAL DEVICE

FIELD OF THE INVENTION

The present invention relates to motorized depilatory devices for removing unwanted skin hair, and more particularly, to a new and useful hair removal device having a rotary head containing multiple springs arranged to pluck skin hair.

BACKGROUND OF THE INVENTION

The prior art of motor-powered depilatory devices using springs for removing skin hair is based on a well-known operational concept of an early mechanical device disclosed in Swiss Pat. 268,696 to Fischer. This hand-operated device uses an arched coil spring to trap hair between its loops as it rolls over the skin. The rolling motion of the coil spring traps hairs in the spaces between the spring loops on the convex side and plucks them when these spaces close on the concave side. Hairs are trapped about one-half of the spring diameter away from the skin, so that short hairs "escape" and are not plucked.

Several tweezer designs are disclosed in the group including Swiss Patent 179,261 to Macioce, U.S. Pat. No. 2,458,911 to Kerr, U.S. Pat. No. 2,486,616 to Schubiger, British Patent 203,970 to Davis, U.S. Pat. No. 1,743,590 to Binz, and U.S. Pat. No. 1,232,617 to Shipp. All are coil spring designs which vary in the mechanical arrangements for stretching the spring and engaging the hair between coil spring loops before it is trapped upon closure of the stretched spring. Because they are based on manual operation, these designs are inherently limited in their efficiency, so that they cannot be directly compared with motorized versions of hair removal devices. In addition, the coil spring provides only limited contact area with individual hairs, and may cause "tearing" rather than plucking of hair, this limiting efficiency.

U.S. Pat. No. 4,079,741 to Daar et al. discloses a single tension spring arranged to be stretched and compressed so as to pluck hairs trapped between its loops. The spring is arranged parallel to the skin and is stretched once during each revolution of a cam, causing friction with the skin and making the operation inefficient. The overall design is complicated and expensive.

An arched helical spring provided with high speed rotational motion for opening and closing the loops is provided in U.S. Pat. No. 4,524,772 to Daar et al. Upon detailed inspection, it is seen that the contact between the helical spring and individual hairs is point-like, so that the hair may be pinched and not plucked. Also, rotation of the helical spring causes transverse deflection of hair, so that shorter hairs are not trapped due to lateral movement of the spaces between the loops. U.S. Pat. Nos. 4,726,375 and 4,807,624 to Gross et al. disclose a rubber hair-plucking element with partially circumferential slits or rubber discs for trapping and plucking skin hair.

These patents are all based on the concept of rotating the coil spring or slits near the skin to enable hairs to become trapped, but they create friction with the skin which causes an unpleasant sensation of heat while consuming excessive motor power during use. The tendency of these spring and rubber elements to "wind" while slowly developing sufficient hair-pulling tension creates additional discomfort in use of these devices.

Because friction is generated with the skin, extra motor power is required, and this is problematic where size restrictions exist for the device.

U.S. Pat. No. 1,923,415 to Bingham discloses a plurality of rotatable discs arranged to be bent one or more times toward each other at a point during each revolution, causing them to pluck bird feathers. This design generates friction with the skin, is inefficient, complicated and expensive to manufacture.

Another device for removing bird feathers is disclosed in French Patent 1,123,971 to Jadoul, based on a plurality of rotatable discs arranged to be bent toward one another at a point during each revolution, again, causing friction and inefficiency.

French Patent 1,017,490 to Bachofen discloses another bird feather plucking device using a set of rotatable discs, each disc having a curved surface area, and being arranged to be bent toward one another at a point during each revolution. Again, friction and inefficiency are disadvantages of the device.

Another poultry feather plucking device is disclosed in U.S. Pat. No. 2,496,223 to Lanzisera, based on the use of a helical spring which rotates on one side of a grid, such that feathers which project through the grid are grasped between loops of the spring and are plucked. This design allows only one plucking action per revolution of the spring, and causes friction, besides being complicated and expensive to manufacture.

In U.S. Pat. No. 4,575,902 to Alazet, there is disclosed a depilatory device comprising a series of adjacent, closely-spaced hair-plucking discs driven by an electric motor. The discs are periodically deformed during rotation so as to trap hair between them as they are pressed together. This design is inefficient since the discs close only once per rotation, limiting plucking action to a short time interval.

A design similar to Alazet is marketed by Calor under the trade name "Caresse" and uses two cam-operated shafts for moving a set of movable tweezers against a set of fixed discs in one direction only, once per revolution. Another similar design is marketed by Braun under the trade name "Silkappeal" and has a plurality of moving segments closing against one another once per revolution. Both are complicated and inefficient designs.

Another disc design is disclosed in U.S. Pat. No. 2,900,661 to Schnell, wherein a pair of discs rotate at a large angle to each other and converge at a contact point whereat hairs are plucked. The large size of this design makes it inefficient, and the inflexible discs tend to cut the hair, not pluck it.

In my previous U.S. Pat. No. 4,935,024 there is disclosed a novel coupled-disc element which reduces the "winding" phenomenon of previous designs, while reducing the painful sensation.

In all of the previous designs, the friction generated with the skin generates heat and causes an unpleasant sensation. In addition, the area over which the hair removal device is effective is determined by the size of the plucking element, which limits the number of hairs which can be simultaneously plucked within this area.

It would therefore be desirable to provide a power-driven depilatory device which provides efficient hair removal over a widened skin area while reducing friction with the skin.

It would also be desirable to provide a depilatory device which is simple in construction for cost-effective production, while durable in use.

Additionally, it would be desirable to provide a depilatory device which minimizes pain and is simple to use and maintain.

SUMMARY OF THE INVENTION

Accordingly, it is a principal object of the invention to provide a hair removal device having a set of multiple springs mounted on a rotary head and arranged to open and close during rotation, to trap and pluck skin hair over a relatively wide area.

It is another object of the present invention to provide a depilatory device which exhibits reduced friction with the skin due to a free rolling action of the spring over the skin.

In accordance with a preferred embodiment of the present invention, there is provided a rotary head multi-spring depilatory device comprising in combination:

a housing;

rotary head means comprising concentrically fixed inner and outer supports having seated radially therebetween a plurality of pins, each pin being radially movable in sliding fashion and having mounted thereon a coil spring, said coil spring having loops defining spaces therebetween which alternately open and close in accordance with said sliding motion of said pin, said rotary head means being arranged to rotate about a shaft fixed within said housing substantially perpendicular to an area of skin from which hair is to be removed;

a motor disposed in said housing and being arranged to rotate said rotary head means about said fixed shaft; and cam means disposed proximate said pins so as to cause said sliding motion of each of said pins synchronous with said rotary head means rotation about said fixed shaft, such that when placed near the skin, rotation of said rotary head means about said fixed shaft causes said spaces of each of said coil springs mounted on a respective one of said plurality of pins to alternately open and close, trapping skin hair in said spaces when opened and plucking it when closed.

In the preferred embodiment, the rotary head multi-spring design is provided as a hand-held, motor-powered depilatory device having a cup-like rotor formed with two concentric supports between which there extend radially the ends of each of a set of pins. A compression coil spring with conically-shaped, small diameter ends and a larger diameter middle section is mounted to rotate freely on each pin, between a shoulder formed at one end of the pin and an end cap slidably seated on its opposite end. The spring has normally open loops with spaces between them along the pin length. As the pin slides radially between the supports, the coil spring becomes compressed between the pin shoulder and end cap, closing its loops. With minor changes, a tension spring is usable.

One end of the pin extends within the area of the inner support, such that it comes into contact with an inner cam mounted at the end of the fixed shaft. The end cap extends beyond the outer support and is in contact with the housing inner wall, which provides an outer cam formed with circumferential projections, each opposite a corresponding inner cam projection. As the rotary head rotates about the shaft, the pin end and end cap ride, respectively, along the shape of the inner and outer cams synchronous with the rotation. This causes movement of the pin end radially outward and movement of the end cap radially inward, simultaneously compressing the ends of the spring and closing its loops.

When passed over the skin, the loops of the multiple springs mounted on the rotary head open and close over a wide area, and the skin hair in this area is grasped and plucked as the loops close, thus performing the hair removal function.

A feature of the present invention is the use of coil springs with loops which are capable of telescopic action, thereby reducing the possibility of overcompressing the springs, which would tend to pinch the hairs and tear them, rather than pluck them from the skin.

In addition, the coil springs are wound using wire having a rectangular cross-section. This feature increases the surface area of contact between individual trapped hairs and the closed spring loop, thus increasing the likelihood of plucking rather than pinching or tearing the trapped hair.

As each of the coil springs on the rotary head comes into contact with the skin, it tends to freely rotate on the pin on which it is mounted. This greatly reduces the level of friction with the skin, consequently minimizing the associated unpleasant sensation, and decreasing the motor power requirement.

In the preferred embodiment, the inner and outer cams, respectively, at the end of the shaft and in the housing inner wall, are shaped with six projections. Additional cam shapes are also possible.

In an alternative embodiment, the cam is provided as a roller bearing arrangement, over which the pins ride to develop the radial sliding movement. Ball bearings may also be applied.

The inventive rotary head multi-spring design has many advantages over the prior art, including simple construction, allowing for cost-effective production, and ease of use.

Other features and advantages of the invention will become apparent from the drawings and the description contained hereinbelow.

BRIEF DESCRIPTION OF THE DRAWINGS

For a better understanding of the invention with regard to the embodiments thereof, reference is made to the accompanying drawings, in which like numerals designate corresponding elements or sections throughout and in which.

DETAILED DESCRIPTION OF THE PREFERRED EMBODIMENTS

Figure 2:
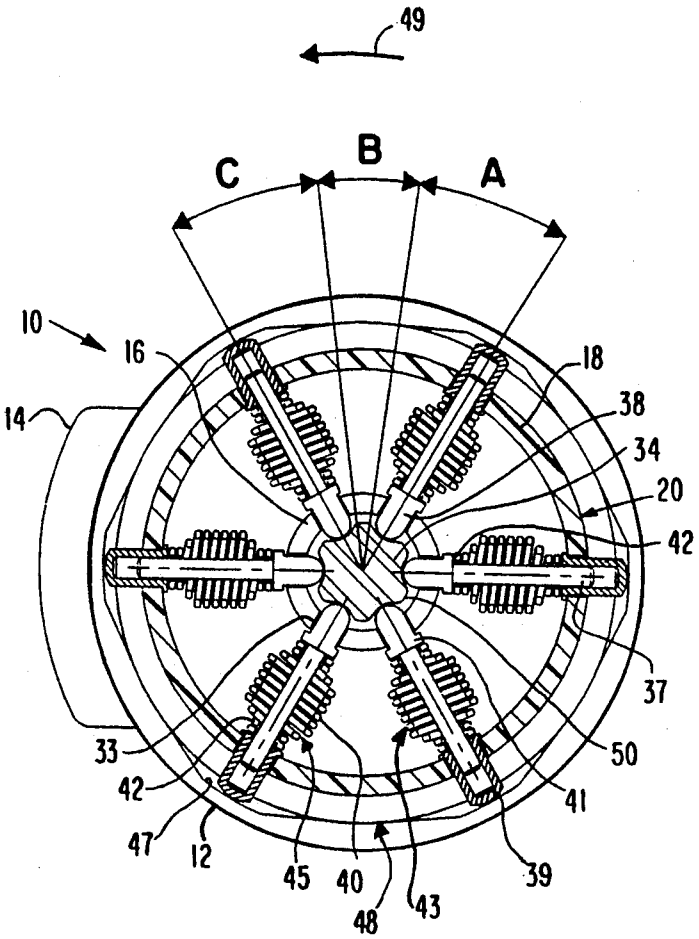
FIG. 2 is a bottom view of the rotary head of the hair removal device of FIG. 1, showing the inner and outer cam design.
Figure 1:
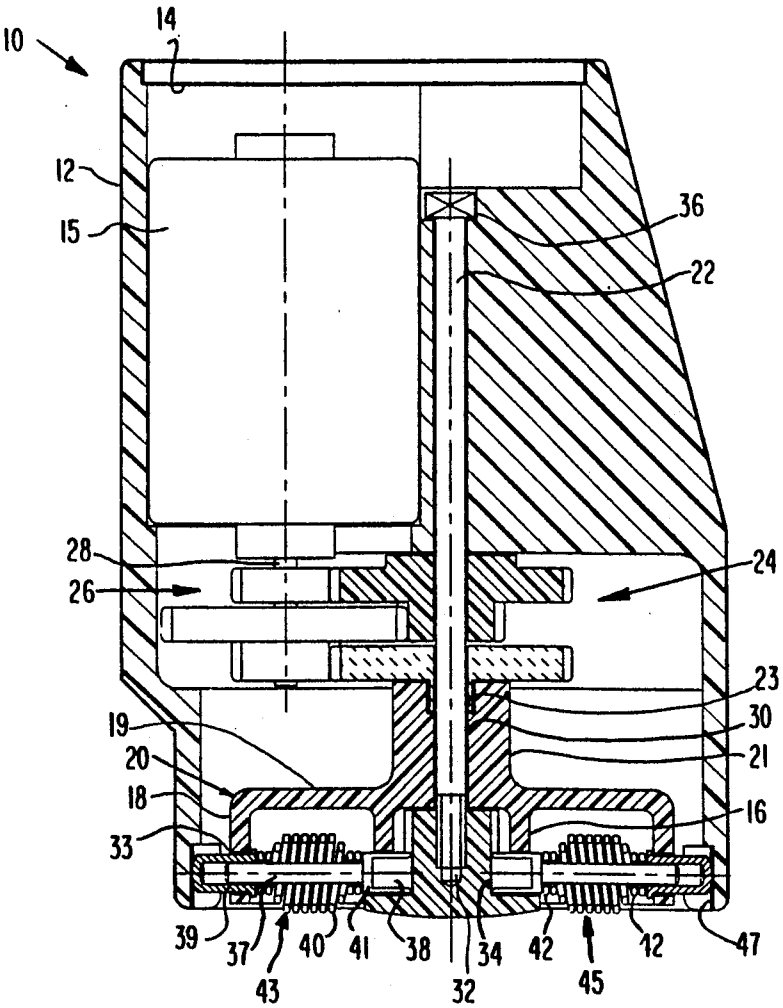
FIG. 1 is a cross-sectional elevation view of a preferred embodiment of a rotary head multi-spring hair removal device constructed and operated in accordance with the principles of the present invention.

Referring now to FIGS. 1–2, there are shown cross-sectional elevation and detail views of a preferred embodiment of a rotary head multi-spring hair removal device 10 constructed and operated in accordance with the principles of the present invention. Device 10 comprises a housing 12, a motor compartment 14 and a miniature electric motor 15 disposed therein. Exposed at the bottom end of housing 12 is a pair of fixed concentric inner and outer annular supports 16 and 18 which form the lower end of a rotary head 20 mounted on a fixed shaft 22.

Supports 16 and 18 are ring-shaped and extend from a disc-shaped surface 19 of rotary head 20 which is integrally formed with a cylindrical hub 21. The upper end of rotary head 20 is coupled via coupling 23 to a set of gears 24 which mesh with drive gears 26 mounted on a drive shaft 28 of motor 15, providing a set of reduction gears. Shaft 22 extends through a central borehole 30 of hub 21, and has fastened to its end 32 an inner cam 34, which is also a retaining nut. The other end of shaft 22 is seated firmly in a hole 36, which is formed in housing 12.

Concentrically fixed annular supports 16 and 18 have openings 33 formed in their circumference at selected points, with pairs of openings 33 serving to retain a set of pins 37 radially spaced apart between supports 16 and 18. One end of pin 37 is supported in opening 33 by pin end 38, and the other end is supported in the other opening 33 by end cap 39 slidably mounted on pin 37. A coil spring 40 wound with conically-shaped, small diameter ends 42 and a larger diameter middle section 43, is retained on pin 37 between pin shoulder 41 and end cap 39. The adjacent, small diameter windings at ends 42 of coil spring 40 form a bearing enabling it to rotate freely on each pin 37. Each spring 40 is a compression spring with normally open loops, providing spaces 45 between them along the pin 37 length.

The normally open condition of each spring 40 causes its ends 42 to push against shoulder 41 and end cap 39 of pin 37, thus forcing pin end 38 to come into contact with inner cam 34. Likewise, end cap 39 comes into contact with inner wall 47 of housing 12, which forms an outer cam 48. When pin 37 is forced to slide radially outward between the rings 16 and 18 by inner cam 34, shoulder 41 thereof causes the coil spring 40 mounted thereon to be compressed, closing its loops, and eliminating spaces 45. Simultaneously, the end cap 39 also compresses spring 40 from its other end 42 as it comes into contact with outer cam 48 (FIG. 2).

It will be appreciated by those skilled in the art that the simultaneous compression of spring 40 from both ends minimizes the tendency for the spring to slide. Thus, transverse deflection of the hair, which would push shorter hairs out from between spring 40 loops, is prevented and efficiency is increased.

It is a particular feature of the present invention that each of springs 40 is designed to be compressible in telescopic fashion. Thus, adjacent, small loops at its ends 42 will be forced within the larger diameter loops at its middle 43, if excessive compression force exists. This design eliminates the unwanted effect of excess compression force, which would pinch and tear trapped hair, not pluck it.

In operation, when motor 15 is powered by batteries or supplied with power by a conventional cord and plug connection (not shown), drive shaft 28 transfers rotational power to rotary head 20 via reduction drive gears 24 and 26. Rotation of rotary head 20 causes supports 16 and 18 to rotate with respect to inner and outer cams 34 and 48, which remain fixed in position. Thus, for each pin 37, when the pin end 38 and end cap 39, respectively, ride along the circumference of inner cam 34 and outer cam 48, pins 37 alternately slide radially outward and end cap 39 slides radially inward synchronous with rotation of rotary head 20. Shoulder 41 and end cap 39 of each pin 37 act simultaneously to compress and then alternately release each of springs 40.

As shown in FIG. 2, during portions of its rotation in the direction of arrow 49, each spring 40 of rotary head 20 passes through three sectors, labeled A, B and C. Sector A represents the portion of rotation during which the loops of spring 40 are open, but are beginning to close. This is because as spring 40 approaches sector B, its associated pin end 38 begins to contact the radially-shaped corner projection 50 of cam 34. During rotation through sector B, the loops of spring 40 are closed, since pin shoulder 41 and end cap 39 move radially toward one another. As it enters sector C, spring 40 loops begin to open, opening fully upon finishing rotation through sector C.

When passed over the skin, the multi-spring arrangement of rotary head 20 operates each of springs 40 in a fixed pattern, opening and closing spaces 45 of its loops, which grasp and pluck skin hair over a wide area. This occurs because individual hairs in a given skin area are trapped within spaces 45 of springs 40 during head 20 rotation through sector A. These hairs are plucked when rotation continues through sector B and the spring 40 loops close. During rotation of rotary head 20 through sector C, these plucked hairs are released as the spring 40 loops open. Since individual springs 40 rotate freely on pins 37, each rolls over the skin when contacting it, reducing friction and minimizing the associated unpleasant sensation.

As shown in FIGS. 1–2, it is a particular feature of the present invention that the coil springs 40 are fabricated of wire having a rectangular cross-sectional area. This increases the surface area of contact between individual trapped hairs and the closed spring loop, thus increasing the likelihood of plucking rather than pinching or tearing the trapped hair. In addition, the telescopic feature of the spring 40 design insures the existence of some additional compressability in spring 40, so that even if excessive compression force exists, spring 40 will not pinch the hair, but will firmly grasp it before plucking it.

Other advantages resulting from the telescopic feature of the spring 40 design include automatic compensation for the wearing of pin end 38 against inner cam 34, and wearing of end cap 39 against outer cam 48. Thus, if pin 37 is initially manufactured with a length slightly greater than necessary, the additional compression forces applied to spring 40 by pin shoulder 41 and end cap 39 are absorbed due to the telescopic feature of the spring design. As pin end 38 and end cap 39 wear during use, sufficient compression forces remain for proper functioning of spring 40. Thus, larger manufacturing tolerances are possible in the inventive design.

Figure 4:
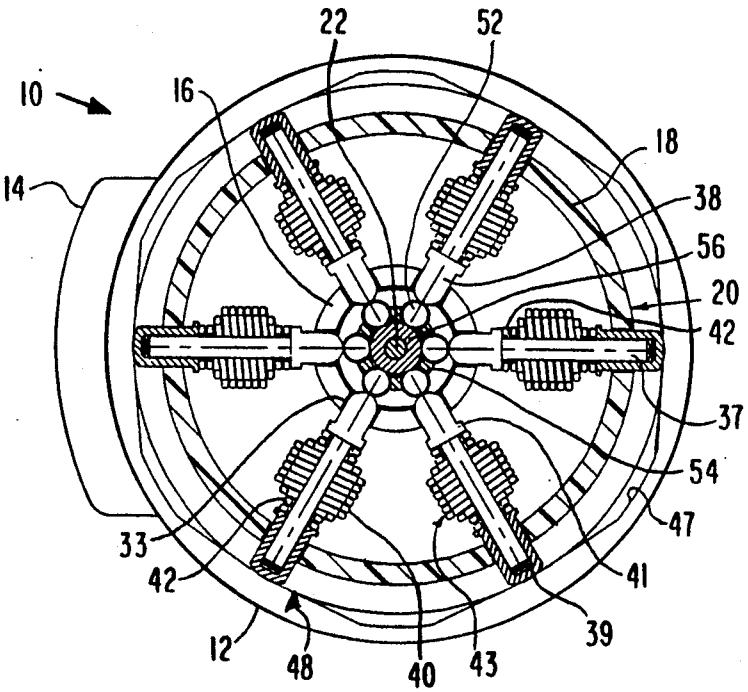
FIG. 4 is a bottom view of the alternative embodiment of the rotary head of FIG. 3, showing a roller bearing inner cam design.
Figure 3:
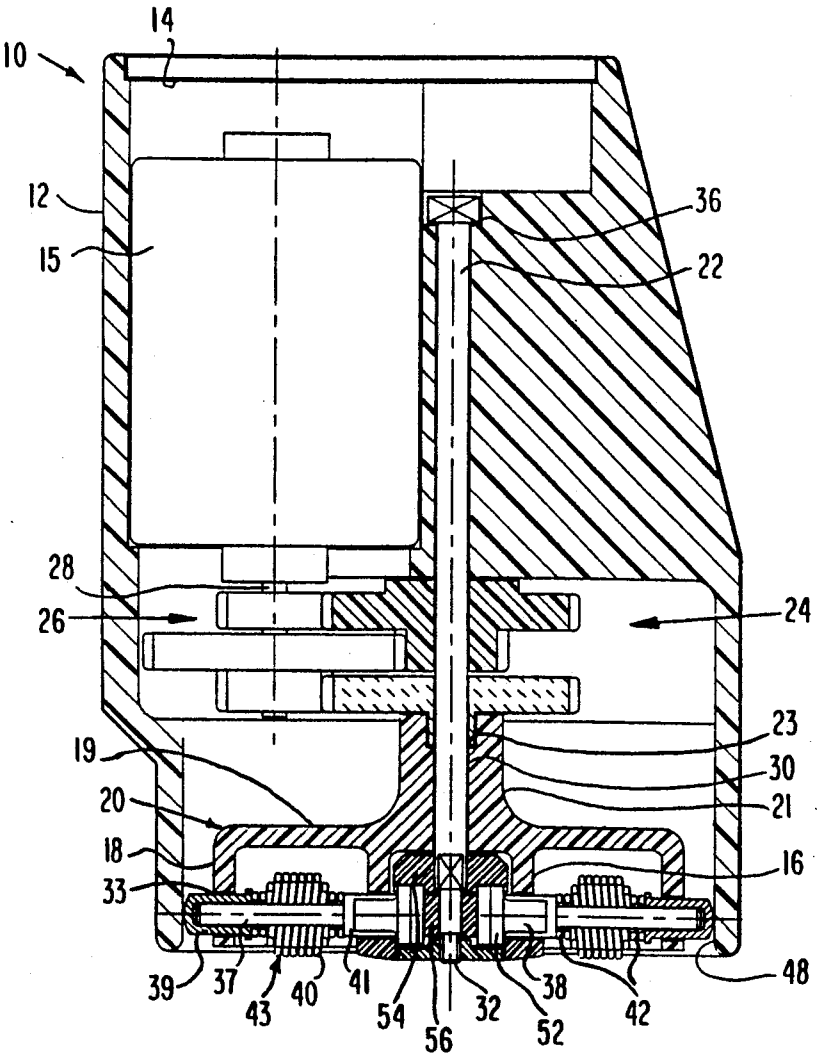
FIG. 3 is a cross-sectional elevation view of an alternative embodiment of the hair removal device of FIG. 1.

In FIGS. 3–4, cross-sectional elevation and bottom views of an alternative embodiment of rotary head 20 are shown, with springs 40 shown compressed, and spaces 45 closed. In this arrangement, inner cam 34 is replaced by a roller bearing 50, in which cylindrically-shaped rollers 52 are provided within a cage 54 which is fixedly mounted on shaft 22 to maintain the space between rollers 52. Each of rollers 52 rotates against a ring 56 which is mounted so as to be freely rotatable on shaft 22. This design reduces friction when pin end 38 rolls over the surface of roller 52. As before, movement of pin end 38 over roller 52 causes alternate outward and inward radial movement of pins 37, so that shoulder 41 and end cap 39 of each pin 37 act simultaneously to alternately compress and release each of springs 40.

In accordance with the principles of the present invention, the rotary head multi-spring design is an efficient mechanical design, allowing for cost-effective production and insuring simplicity of use. In addition, the inventive design achieves more plucking operations per rotary head 20 revolution, since at any instant, springs 40 may be compressed as they are continuously in contact with the skin.

Having described the invention with regard to certain specific embodiments, it is to be understood that the description is not meant as a limitation since further modifications will now suggest themselves to those skilled in the art and it is intended to cover such modifications as fall within the scope of the appended claims.

I claim:

1. A rotary head multi-spring depilatory device comprising in combination:

a housing;

rotary head means comprising concentrically fixed inner and outer supports having seated radially therebetween a plurality of pins, each pin being radially movable in sliding fashion and having mounted thereon a coil spring, said coil spring having loops defining spaces therebetween which alternately open and close in accordance with said sliding motion of said pin, said rotary head means being arranged to rotate about a shaft fixed within said housing substantially perpendicular to an area of skin from which hair is to be removed;

a motor disposed in said housing and being arranged to rotate said rotary head means about said fixed shaft; and cam means disposed proximate said pins so as to cause said sliding motion of each of said pins synchronous with said rotary head means rotation about said fixed shaft, such that when placed near the skin, rotation of said rotary head means about said fixed shaft causes said spaces of each of said coil springs mounted on a respective one of said plurality of pins to alternately open and close, trapping skin hair in said spaces when opened and plucking it when closed.

2. The device of claim 1 wherein said cam means comprises a cage fixed on said shaft having mounted therein a roller bearing with cylindrical rollers rotating against a ring mounted so as to be freely rotatable on said fixed shaft, such that during rotation of said rotary head means, friction is reduced when ends of said pins roll over the surface of said rollers, which roll over said ring.

3. The device of claim 1 wherein each of said coil springs is freely rotatable about the pin on which it is mounted, to reduce friction against the skin.

4. The device of claim 1 wherein each of said coil springs is a compression spring.

5. The device of claim 4 wherein each of said coil springs has conically-shaped ends having a smaller diameter and a middle section having a larger diameter, adjacent loops of said smaller ends acting as a bearing about which said coil spring freely rotates on said pin when contacting the skin.

6. The device of claim 5 wherein said smaller diameter ends of each of said coil springs are insertable within said larger diameter middle section in telescopic fashion, automatically compensating for excessive pin motion by absorbing excess compression forces between adjacent coil spring loops.

7. The device of claim 1 wherein each of said coil springs is a tension spring.

8. The device of claim 1 wherein said coil spring has a rectangular cross-section for increasing the surface contact area between said coil spring loops and said trapped hair.

9. The device of claim 1 wherein each of said pins is formed with a shoulder nearest said inner support and has an end cap slidably mounted thereon nearest said outer support, and wherein said cam means comprises an inner and outer cam, said inner cam being mounted on said fixed shaft, said outer cam being seated on an inner wall of said housing, said pin contacting at its respective ends, said inner and outer cams, such that during said rotation, said pin shoulder and said end cap alternately compress and release said coil spring simultaneously, while said coil spring remains substantially in place on said pin, to minimize transverse hair deflection and insure plucking of trapped hair.

10. The device of claim 9 wherein said inner cam comprises a plurality of radially-shaped corner projections, and said outer cam comprises a plurality of projections seated on said housing inner wall, each opposite one of said inner cam projections.

11. A method of removing unwanted skin hair comprising the steps of:

providing a rotary head multi-spring depilatory device comprising:

a housing having rotary head means comprising concentrically fixed inner and outer supports having seated radially therebetween a plurality of pins, each pin being radially movable in sliding fashion and having mounted thereon a coil spring, said coil spring having loops defining spaces therebetween which alternately open and close in accordance with said sliding motion of said pin, said rotary head means being arranged to rotate about a shaft fixed within said housing substantially perpendicular to an area of skin from which hair is to be removed; and cam means disposed proximate said pins so as to cause said sliding motion of each of said pins synchronous with rotation of said rotary head means about said fixed shaft; and rotating said rotary head means while it is passed over the skin to cause said spaces of each of said coil springs mounted on a respective one of said plurality of pins to alternately open and close, trapping skin hair in said spaces when opened and plucking it when closed.

12. The method of claim 11 wherein said rotary head means is in continuous contact with the skin, allowing said coil springs to trap and pluck skin hair at any time during said rotation.

13. The method of claim 11 wherein said cam means comprises inner and outer cams, said inner cam being mounted on said fixed shaft, said outer cam being seated on an inner wall of said housing, said pins being in contact at their ends, respectively, with said inner and outer cams such that during said rotation, said inner and outer cams alternately compress and release said coil spring simultaneously, while said coil spring remains substantially in place on said pin, to minimize transverse hair deflection and insure plucking of trapped hair.

14. The method of claim 11 wherein each of said coil springs is freely rotatable about the pin on which it is mounted, to reduce friction against the skin.

15. The method of claim 11 wherein said coil springs are compressible in telescopic fashion, automatically compensating for excessive pin motion by absorbing excess compression forces between adjacent coil spring loops.

16. The method of claim 11 wherein said rotating step is performed by an electrically-powered motor disposed in said housing and arranged to drive said rotary head means.

* * * * *